United States Patent [19]

Rahn

[11] 4,036,727

[45] July 19, 1977

[54] ELECTRODE UNIT

[75] Inventor: Henry W. Rahn, Pittsburgh, Pa.

[73] Assignee: PPG Industries, Inc., Pittsburgh, Pa.

[21] Appl. No.: 678,781

[22] Filed: Apr. 20, 1976

Related U.S. Application Data

[62] Division of Ser. No. 522,669, Nov. 11, 1974, Pat. No. 3,984,304.

[51] Int. Cl.[2] ..... C25B 1/26; C25B 9/02

[52] U.S. Cl. ..... 204/268; 204/254; 204/286; 204/288; 204/291

[58] Field of Search ..... 204/98, 128, 252, 254, 204/255, 256, 266, 267, 275, 286, 280, 288, 289, 291, 268, 269, 290 R, 292

[56] References Cited

U.S. PATENT DOCUMENTS

| | | | |
|---|---|---|---|
| 2,282,058 | 5/1942 | Hunter et al. | 204/256 |
| 3,591,483 | 7/1971 | Loftfield et al. | 204/266 X |
| 3,759,815 | 9/1973 | Larsson | 204/268 |
| 3,761,384 | 9/1973 | Ruthel et al. | 204/288 |
| 3,766,036 | 10/1973 | McKaveney | 204/150 X |
| 3,813,326 | 5/1974 | Gunby | 204/268 |
| 3,852,175 | 12/1974 | Hoekje | 204/98 |

FOREIGN PATENT DOCUMENTS

| | | | |
|---|---|---|---|
| 1,160,999 | 8/1969 | United Kingdom | 204/266 |

*Primary Examiner*—Arthur C. Prescott
*Attorney, Agent, or Firm*—Richard M. Goldman

[57] ABSTRACT

Disclosed is an anode assembly for electrolytic cells. The anode assembly includes a plurality of parallel silicon anode blades. Between each pair of silicon anode blades are electrolyte-resistant spacers and flexible gaskets with at least one flexible gasket being interposed between the spacer and the silicon anode adjacent thereto and at least one flexible gasket being interposed between the opposite surface of the spacer and the silicon anode adjacent thereto. The anode assembly further includes compressive means passing through each of the silicon anodes, through the flexible gaskets, and through the spacers, providing a compressive force thereon, and this way providing an electrolyte tight seal between the anodes, the flexible gaskets, and the spacers, and this way providing an electrolyte tight wall having silicon anodes extending therefrom.

3 Claims, 6 Drawing Figures

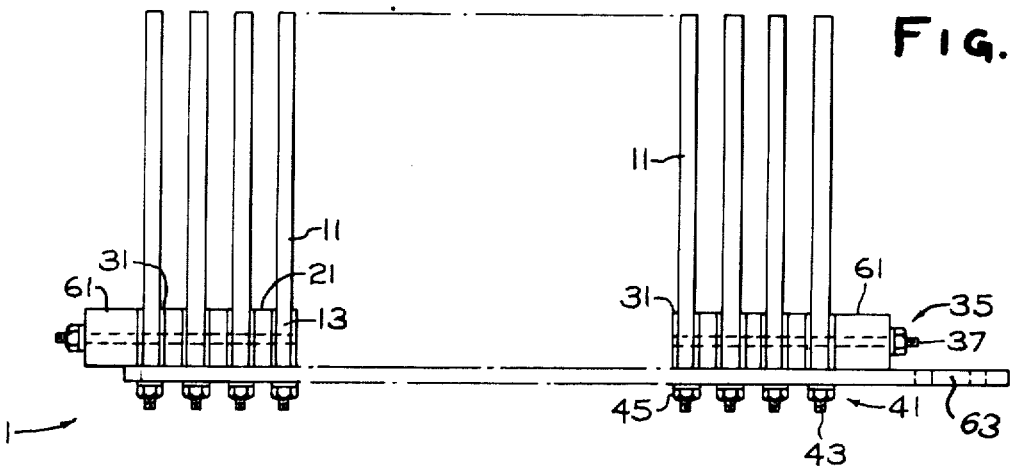
FIG. 1
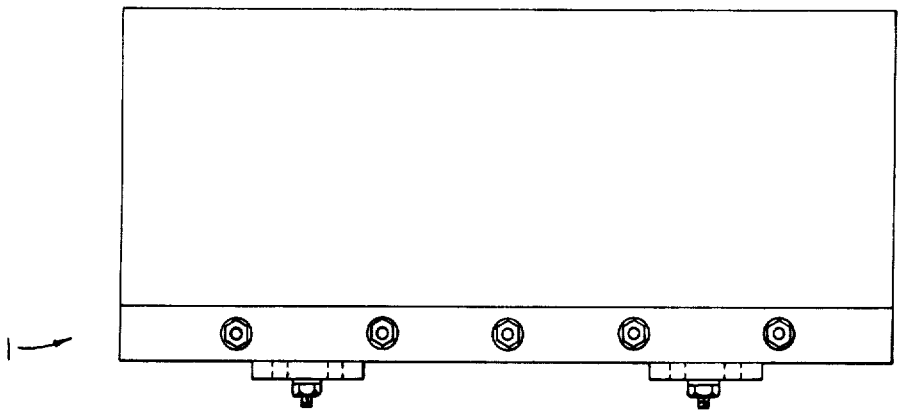
FIG. 2
FIG. 5
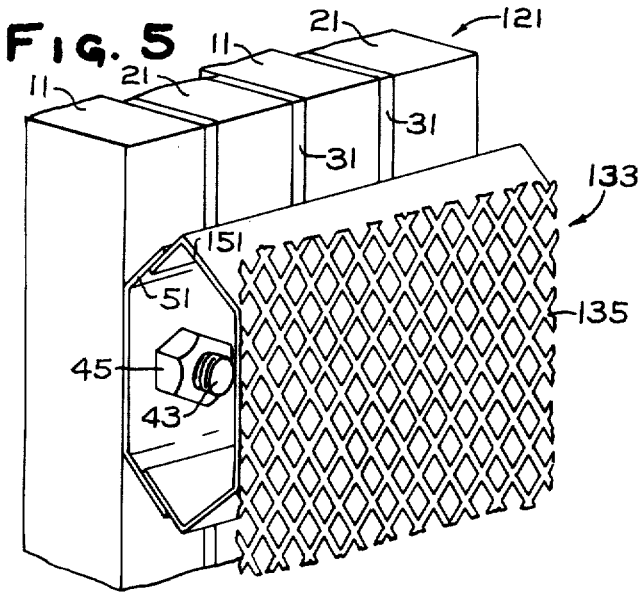
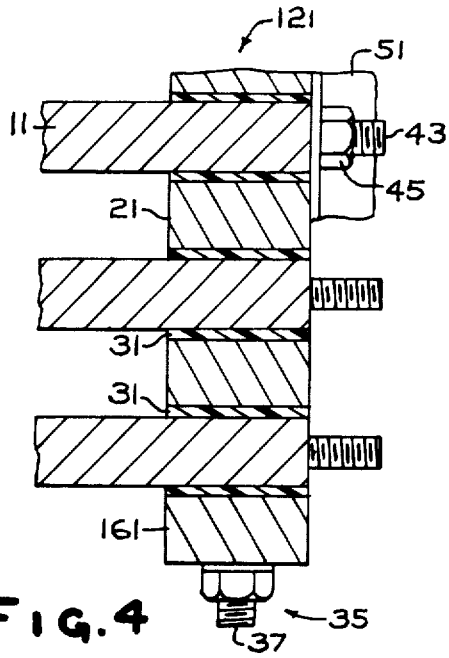
FIG. 4

ELECTRODE UNIT

This is a division of application Ser. No. 522,669 filed Nov. 11, 1974, now U.S. Pat. No. 3,984,304.

BACKGROUND OF THE INVENTION

Alkali metal chloride brines, such as sodium chloride and potassium chloride, may be electrolyzed to yield the alkali metal hydroxide, sodium hydroxide or potassium hydroxide, and chlorine. This process may be carried out in a diaphragm cell having an acidic anolyte and a basic catholyte, the anolyte and catholyte being separated by a permeable barrier.

The anodic reactions are:

$$Cl^- + \rightarrow Cl + e^-$$
$$2\,Cl \longrightarrow Cl_2$$

and the cathodic reactions are:

$$H^+ + e^-$$
$$2\,H \longrightarrow H_2$$

Typically the anolyte liquor is acidified brine having a pH of from about 2.5 to about 4.5 and the catholyte liquor is an aqueous solution of alkali metal hydroxide and alkali metal chloride. In a caustic soda diaphragm cell, the catholyte liquor contains from about 7 to 12 weight percent of sodium.hydroxide from about 10 to 15 weight percent of sodium chloride.

Typically in diaphragm cells, the anode has been either a graphite anode or an electrocatalytically coated valve metal anode. Valve metals are those metals that form a passivating, insert film upon exposure to acidic media under anodic conditions. Typical of the valve metals are titanium, tantalum, tungsten, zirconium, and hafnium.

SUMMARY OF THE INVENTION

According to this invention, there is now provided an anode unit useful in diaphragm cells for the electrolysis of alkali metal chloride brines to yield chlorine and alkali metal hydroxide. The anode assembly includes a plurality of parallel silicon anodes. Each of the silicon anodes has a silicon substrate with an electrical conductivity greater than about 100 (ohm-centimeters) $^{-1}$, an electrically conductive surface thereon, and an aperture passing through a lower portion of the silicon substrate. Each silicon anode also includes electrically conductive means at the bottom of the silicon substrate. The anode asembly further includes electrolyte-resistant spacers. At least one electrolyte-resistant spacer is disposed between each pair of adjacent silicon anodes. Each spacer has an aperture corresponding to the apertures in the silicon anode substrates. The anode assembly may further include flexible gaskets with a gasket interposed between an electrolyte-resistant spacer and the silicon anode adjacent to one surface of the spacer, and a gasket interposed between the opposite surface of the spacer and the silicon anode adjacent to that opposite surface. Each of the flexible gaskets has apertures corresponding to the apertures in the silicon substrates and the silicon spacers.

Compressive means, such as a bolt or rod, pass through the anodes, the flexible gaskets, and the electrolyte-resistant spacers, providing a compressive force thereon. This provides an electrolyte tight seal between the silicon anode and the flexible gaskets adjacent thereto, and between the electrolyte-resistant spacers and the flexible gaskets adjacent thereto. In this way, an electrolyte tight wall is provided which has silicon anodes extending from one side and electrical connection means extending to the opposite side.

The anode assembly of this invention may be a monopolar anode assembly, providing the floor of a monopolar electrolyte diaphragm cell. It may also be the anode assembly of the bipolar unit of a bipolar diaphragm cell, with a cathode assembly of an adjacent diaphragm cell connected to the anode assembly by the electrical connecting means on the bases of the anodes.

DETAILED DESCRIPTION OF THE INVENTION

The anode assembly of this invention may be understood by reference to the appended figures. In the figures:

FIG. 1 is a side elevation of an anode assembly.

FIG. 2 is a front elevation of the anode assembly of this invention.

FIG. 4 is a plane view in a cutaway of an anode assembly of this invention useful in a bipolar electrolyzer.

FIG. 5 is a perspective of a segment of an anode assembly of this invention in combination with a cathode assembly, useful in a bipolar electrolyzer.

Figure 3:
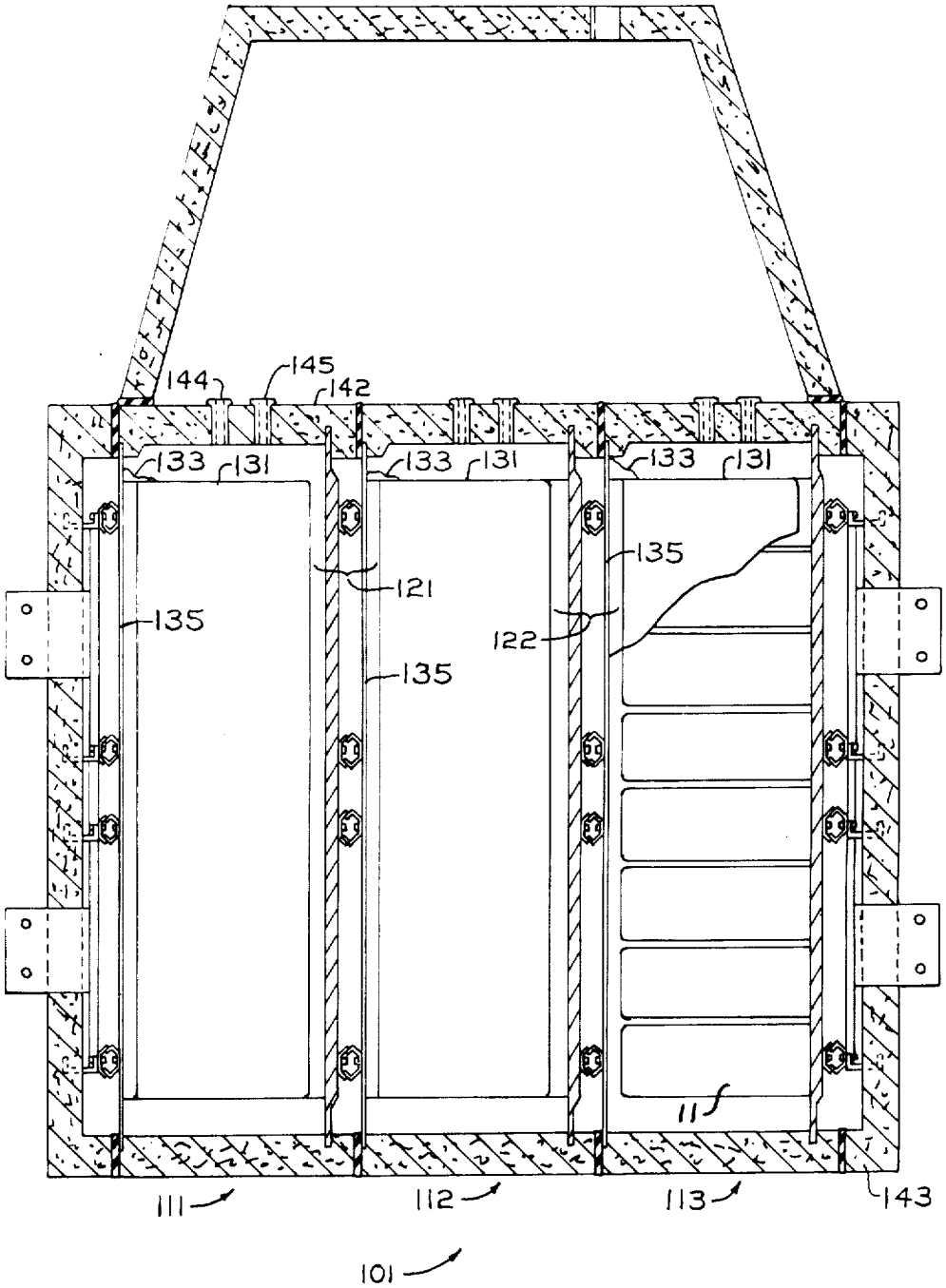
FIG. 3 is a side elevation in cutaway of a bipolar electrolyzer utilizing an anode assembly of this invention.

In a monopolar diaphragm cell, the cell bottom has the anodes extending upwardly therefrom. A cell can or cathode chamber sits on the cell bottom and is electrically insulated therefrom. The cell can or cathode chamber includes an outer wall and an inner wall which may be perforate or foraminous. Electrodes, i.e., cathodes, extend outwardly from opposite inner foraminous or perforate walls. The cathodes extend from one inner perforate or foraminous wall to the opposite inner perforate or foraminous wall so as to be interleaved between the anodes.

The perforate or foraminous cathodes and side walls are covered by a permeable barrier which may either be an electrolyte permeable barrier such as a diaphragm or an ion permeable, electrolyte impermeable barrier as a permionic membrane.

Within the cathodes and between the inner peripheral wall and the exterior wall is the catholyte chamber of the cell. The balance of the interior of this cell is the anolyte chamber. Typically a monopolar cell includes a brine feed means into the anolyte chamber and chlorine recovery from the anode chamber. A monopolar cell also includes cell liquor recovery from the catholyte chamber and hydrogen recovery from the catholyte chamber.

A cell bottom for monopolar cells and especially for the conversion of graphite anode monopolar cells to silicon anode monopolar cells is shown in FIGS. 1 and 2. As there shown, silicon anodes II extend upwardly from the base of the anode unit 1.

The silicon anodes are fabricated of silicon base alloy having an electrical conductivity in excess of 100 (ohm-centimeters)$^{-1}$ and preferably in excess of 1,000 (ohm-centimeters)$^{-1}$. The desired electroconductivity may be provided by an alloy containing substantial amounts of silicon, from about 0.2 to about 2 percent of a dopant such as boron or phosphorous or the like, and from the trace amounts up to about 15 percent of a transition metal such as iron, coblat, nickel, or the like.

The silicon useful in providing the bipolar electrodes contemplated herein has chemical resistance to the electrolyte and to products of the electrolytic process. This chemical resistance is typically provided by the formation of a film or a layer of a silicon oxide, e.g., $SiO_2$, or sub-oxides thereof, on the areas of the silicon exposed to the electrolyte.

Additionally, silicon electrodes contemplated herein for use in bipolar electrodes should have physical strength in order to be resistant to impact and abrasion. Physical strength may be provided by the presence of small amounts of alloying agents.

The electrical conductivity may be provided either by the presence of a dopant, i.e., an electron donor or an electron acceptor. Suitable electron donors are nitrogen, phosphorous, arsenic, antimony, and bismuth. Suitable electron acceptors are boron, aluminum, gallium, indium, thallium, and the like. For electrochemical applications, i.e., for use as electrodes in electroconductive media, electron acceptors appear to impart chemical resistance to the silicon.

The dopant used in providing improved electrical conductivity which dopant may either be an electron acceptor or an electron donor, should be present in an amount greater than 0.01 weight percent of the silicon, and preferably in an excess of about 0.1 percent of the silicon. Generally, the dopant should be less than about 3 weight percent of the silicon, and almost always less than about 5 weight percent of the silicon. The presence of small amounts of the dopant increases the electrical conductivity from about 10 (ohm-centimeters)$^{-1}$ or less which is characteristic of commercial and reagent grades of silicon to in excess of 100 (ohm-centimeters) and preferably to in excess of 1,000 or even 10,000 (ohm-centimeters) or even higher which is comparable to graphite and conventional metallic conductors.

Particularly good results are obtained when the dopant is one or more electron acceptors, i.e. boron, aluminum, gallium, indium, thallium, and the like, preferably including boron, and the concentration of dopants is from about 0.1 weight percent of the silicon to about 1.5 or even 2 weight percent of the silicon.

Increased physical strength and castability may be provided by alloying agents such as aluminum, gallium, manganese, iron, cobalt, nickel, chromium, or molybdenum. These alloying agents, when present, may be present in total concentration, i.e., as a silicide and as the metal, in excess of one-half percent by weight, preferably in excess of about two to eight percent by weight, frequently as high as 30 percent by weight or even more, but generally not greatly in excess of about 40 percent by weight. These alloying agents serve to increase the malleability and ductility of the elemental silicon. Elemental silicon as the term is used herein is silicon having a formal valence of 0.

In addition to elemental silicon, the various silicides may be present within and on the surface of the silicon anodes useful in the anode units of this invention. While the silicide is used herein, it is to be understood that such term also encompasses metallic solid solutions of silicon and the metal referred to as being present as a silicide, metallic solid solutions of silicon and the silicide, and metallic solutions of the silicides. Additionally, it is to be understood that when silicides and alloying agents are referred to, they may be present in a complex metallurgical system of substantially pure silicon phases, substantially pure silicide phases, and phases which are a metallic solid solution of various silicides and metallic solid solutions of silicon and various silicides. The silicides serve to provide additional electroconductivity to the silicon bipolar electrodes of this invention. Such silicides include the electroconductive silicides of various metals such as lithium silicide, boron silicide, sodium silicide, magnesium silicide, phosphorous silicide, hafnium silicide, calcium silicide, titanium silicide, vanadium silicide, chromium silicide, iron silicide, cobalt silicide, copper silicide, arsenic silicide, rubidium silicide, strontium silicide, zirconium silicide, nibium silicide, molybdenum silicide, ruthenium silicide, rhodium silicide, palladium silicide, tellurium silicide, cesium silicide, barium silicide, silicides of the rarer metals, tantalum silicide, tungsten silicide, rhenium silicide, osmium silicide, iridium silicide, and platinum silicide.

The silicides themselves, while providing increased electroconductivity to the elemental silicon base membes have fairly poor mechanical properties and, when present as a dominant phase, may serve to decrease the ductility of the silicon base member. For this reason, they will generally not be the major fraction of the material present within the electrode nor will they be present as the metallurgically dominant phase. Generally, silicides, when present, should be less than about 50 percent of the total weight of the electrode. Most frequently, the silicide will be less than 20 weight percent of the total electrode and frequently less than about 5 weight percent of the total electrode.

When silicides are present in the electrode substrate, they will most commonly be the silicides of the dopants and additives, such as arsenic, boron, copper, iron, cobalt, nickel, manganese, and phosphorous; the silicides of the valve metals such as titanium, tantalum, tungsten, zirconium. hafnium, vanadium, niobium; and the silicides of the platinum group metals, ruthenium, rhodium, palladium, osmium, irridium, and platinum.

Particularly desired silicides which may be present within the electrodes and on the surfaces thereof, especially on the anodic surface of the bipolar electrodes herein contemplated, are the highly electroconductive silicides such as the silicides of the platinum group metals, e.g., $Pt_3Si$, $Pd_3Si$, $Ir_3Si_2$, $Rh_3Si_2$, and $Ru_3Si_2$; the silicides of the valve metals, e.g., $TiSi_2$, $ZrSi_2$, $VSi_2$, $NbSi_2$, $TaSi_2$, and $WSi_2$; and the silicides of the heavy metals, e.g., $Cr_3Si$, $Cr_5Si_3$, $Cr_5Si_3$, CrSi, $CrSi_2$, $CoSi_2$, and $MoSi_2$.

The preferred silicon alloys useful in providing the anode assemblies of this invention contain from about 0.01 to about 5 percent of a dopant, as defined above, from no alloying elements, to about 50 percent alloying elements, including silicides, and generally from about 5 percent to about 30 percent alloying elements, including silicides, as defined above, and balance predominantly silicon, e.g., from about 45 to about 99 percent.

The silicon anode substrate typically has a coating thereon to provide a steady state chlorine overvoltage of less than 0.250 volt at 200 Amperes per square foot. Typically, steady state is attained at a time of from about several minutes after commencing the test for 3 or 4 days after the commencing test. The chlorine overvoltage is determined as follows:

A two-compartment cell constructed of polytetrafluoroethylene with a diaphragm composed of asbestos paper is used in the measurement of chlorine overpotentials. A stream of water-saturated $Cl_2$ gas is dispersed into a vessel containing saturated NaCl, and the resulting $Cl_2$-saturated brine is continuously pumped into the anode chamber of the cell. In normal operation, the temperature of the electrolyte ranges from 30° to 35° C, most commonly 32° C, at a pH of 4.0. A platinized titanium cathode is used.

In operation, an anode is mounted to a titanium holder by means of titanium bar clamps. Two electrical leads are attached to the anode; one of these carries the applied current between anode and cathode at the voltage required to cause continuous generation of chlorine. The second is connected to one input of a high impedance voltmeter. A Luggin tip made of glass is brought up to the anode surface. This communicates via a salt bridge filled with anolyte with a saturated calomel half cell. Usually employed is a Beckman minature fiber junction calomel such as catalog No. 39270, but any equivalent one would be satisfactory. The lead from the calomel cell is attached to the second input of the voltmeter and the potential read.

Calculation of the overvoltage, $\eta$, is as follows:

The International Union of Pure and Applied Chemistry sign convention is used, and the Nernst equation taken in the following form:

$$E = E_o + \frac{2.303\,RT}{nF} \log \frac{[\text{oxidized}]}{[\text{reduced}]}$$

Concentrations are used for the term in brackets instead of the more correct activities.

$E_o$ = the standard state reversible potential = + 1.35 volts $n$ = number of electrons equivalent $^{-1}$ = 1

R, gas constant, = 8.314 joule $\text{deg}^{-1}$ mole $^{-1}$

F, the Faraday = 96,500 couloumbs equivalent $^{-1}$ $Cl_2$ concentration = 1 atm Cl− concentration = 5.4 equivalent liter− $^{1}$(equivalent to 305 grams NaCl per liter)

T = 305° K

For the reaction;

$$\cdot Cl \longrightarrow \tfrac{1}{2}Cl_2 + e^-,$$
$$E = 1.35 + 0.060 \log 1/5.4 = 1.30$$

This is in the reversible potential for the system at the operating conditions. The overvoltage on the normal hydrogen scal is, therefore, $$\eta = \nu = [E - 0.24]$$

where V is the measured voltage and E is the reversible potential.

An aperture 13 passes through the lower portion of silicon anode blades. By lower portion of the anode blade is meant the segment of the silicon anode 11 below the level of the top of the spacers 21 and below the level of electrolyte within the cell. The aperture 13 passes from one surface face of the silicon anode blade 11, through the silicon anode blade 11, to the opposite surface of the silicon anode blade 11 and corresponds to analogous apertures 13 in adjacent electrodes 11, spacers 21, and gaskets 31, and provides for the passage of compressive means 35 therethrough.

Electrical connection means 41 are on the bottom of the silicon anode substrate 11. The electrical connection means 41 extend downwardly below the bottom of the cell.

The electrical connection means 41 may be an electroconductive rod 43 extending outwardly from within the silicon anodes 11, for example, an electroconductive rod 43 such as which may be a copper rod or an aluminum rod. Alternatively, the electrical connection means 41 at the bottom of the silicon anode 11 may be an aperture through which a copper or aluminum bus bar may extend or even a clip means 51 such as a copper clip connecting to the bus bar.

The electrolyte-resistant spacers 21 are provided between each pair of adjacent silicon anodes 1. The electrolyte-resistant spacers 21 have an aperture 23 corresponding to the aperture 13 in the silicon anodes 11. The electrolyte-resistant spacers 21 may be fabricated of any electrolyte-resistant material, for example, a valve metal as described above, graphite, or silicon. Most commonly, the electrolyte-resistant spacers 21 are fabricated of silicon.

Flexible gaskets 31 are interposed between each spacer 21 and the silicon anode 11 adjacent thereto, and between the opposite surface of the spacer 21 and the silicon anode 11 adjacent to the opposite surface.

Compressive means 35, such as rod 37, passes through each of the silicon anodes 11, spacers 21, and gaskets 31. As shown in FIG. 1, an end plate 61 may be placed at each end of the anode assembly 1 to distribute the force of the compressive means 35 evenly across the faces of the anode assembly. Multiple compressive means 35 may be positioned periodically, e.g., every 6 inches or 9 inches or 12 inches or even every 15 or 18 or 24 inches through the anode assembly 1 to provide even compression of the gaskets 31.

The compressive rods 37 provide a compressive force on the anode assembly. In this way, an electrolyte tight seal is provided between each of the silicon anodes 11 and the adjacent gaskets 31 and between each of the electrolyte-resistant spacers 21 and the adjacent gaskets 31.

The anode assembly 1 described above provides an electrolyte tight cell bottom for insulation in a monopolar cell designed therefor or in a monopolar cell originally constructed for graphite electrodes and subsequently converted to silicon anode operation. In such a monopolar cell, a copper bus bar 63 may connect with the electrical connection means 41 on the bottom of the silicon anodes 11. For example, the copper bus bar 63 may be clipped to the bottom of the silicon anodes 11 by the clips 51 or may be bolted to the bottom of the silicon anodes 11 by bolt means 45.

According to another exemplification of this invention, the silicon anode assembly may be used as the anode assembly of a bipolar unit.

Figure 6:
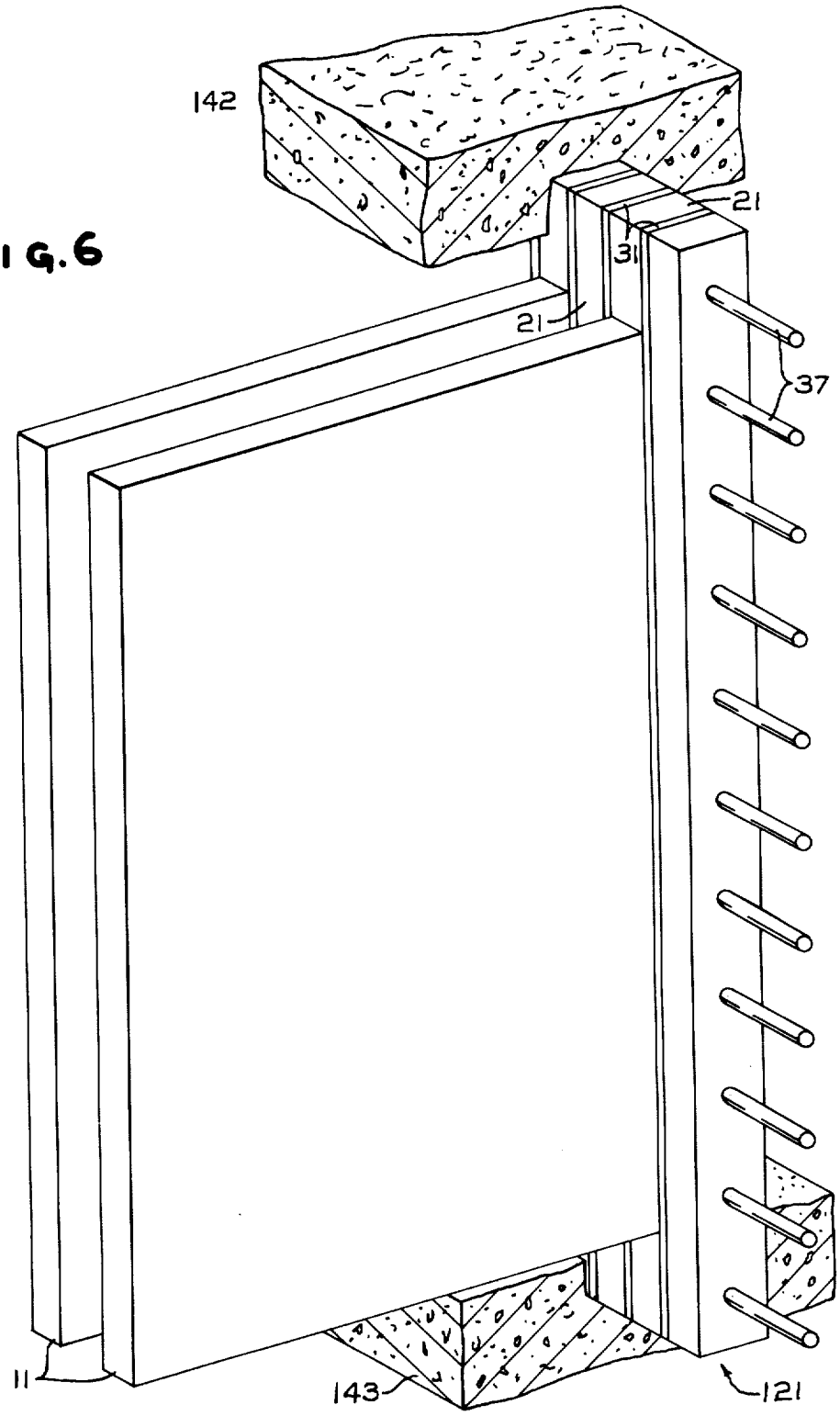
FIG. 6 is a perspective view of the bipolar unit of FIG. 5 from the opposite side thereof.

A bipolar electrolyzer 101 includes a plurality of individual electrolytic cells 111, 112, 113, mechanically and electrically in series with a common structural member, i.e., a bipolar unit 121. A bipolar unit includes the cathodes 131 of one cell and the anodes 11 of the next adjacent cell. Such a bipolar unit 121 is shown, for example, in FIGS. 3, 4, 5, and 6.

Within an individual cell of a bipolar electrolyzer 101, the anodes 11 of one bipolar unit, that is the anode unit 1 of one bipolar unit 121, and the cathodes 131 of the next adjacent bipolar unit 122, that is the cathode unit of the next adjacent bipolar unit, provide the anodes 11 and cathodes 131 of an individual cell 16. The anodes 11 and cathodes 131 may be interleaved between each other in a fingered arrangement.

A bipolar electrolyzer typically includes side walls 141, a top 142, and a bottom 143. A bipolar electrolyzer further includes means 144 to feed brine into the cell and means 45 to recover chlorine from the anolyte chamber as well as means 146 to recover cell liquor, e.g., alkali metal hydroxide and alakali metal chloride and hydrogen 147 from the catholyte chamber.

A bipolar electrolyzer includes an anodic half cell at one end of the electrolyzer, a cathodic half cell at the opposite end of the electrolyzer, and a plurality of bipolar units 121, 122, 123 therebetween. A typical bipolar electrolyzer may include anywhere from one to three or five or more bipolar units within a given electrolyzer. For example, a bipolar electrolyzer may have 11 or 15 or 21 or more bipolar units in a single electrolyzer.

The anodic unit of the bipolar unit includes silicon anodes extending outwardly from the bipolar unit. Silicon anodes are fabricated of a silicon base alloy having electrical conductivity greater than 100 (ohm-centimeters)$^{-1}$ and preferably in excess of 1,000 (ohm-centimeters)$^{-1}$. Such a silicon base alloy may be provided as described hereinabove. The silicon base alloy substrate typically has a coating thereon having a steady state chlorine overvoltage of less than 0.250 volt at 200 Amperes per square foot as described hereinabove.

Apertures 13 pass through the base of the silicon alloy anodes 11. By the base of the silicon anode 11 is meant that portion of the silicon anode 11 behind the spacers 21 and toward the cathodic unit of the bipolar unit. Typically, in a bipolar unit 121, the apertures 13 pass horizontally from one surface of the silicon anode 11 to the opposite surface of the silicon anode 11 as shown with particularity in FIG. 6.

Elastic clip means 51 on the base of the silicon anodes 11 may be used for connection with corresponding electrical connection means 151 on the cathode unit of the bipolar unit 121, that is, on the cathode unit of the prior cell of the bipolar electrolyzer 101.

A plurality of electrolyte-resistant spacers 21 are disposed between each pair of adjacent silicon anodes 11. In this way, space is provided for the interleaved cathodes 131 of the cell 101 to fit between the anodes 11 of the cell 101.

The electrolyte-resistant spacers 21 include apertures 23 corresponding to the apertures 13 in the silicon anodes 11. The electrolyte-resistant spacers 21 may be provided by any of the materials resistant to the effects of acidified brine under anodic conditions. For example, spacers may be provided by a valve metal such as titanium, tantalum, tungsten, hafnium, or zirconium. Alternatively, the electrolyte-resistant spacers 21 may be provided by graphite or by silicon. According to a preferred exemplification of this invention, the electrolyte-resistant spacers 21 are provided of silicon.

Flexible gaskets 31 are interposed between a spacer 21 and a silicon anode 11 adjacent thereto, and between the opposite surface of the spacer 21 and the silicon anode 11 adjacent to that opposite surface. The flexible gaskets 31 also include apertures 33 corresponding to the apertures in the electrolyte-resistant spacers 21 and in the silicon anodes 11. The flexible gasket 31 may be fabricated of any material resistant to the effects of chlorinated brine under anodic conditions. For example, the flexible gasket may be fabricated of polycarbonate materials, polyester materials, or chlorinated polyvinychloride type materials.

Compressive means 35 such as bars or rods 37 pass horizontally through the apertures of the anodic unit from side to side, passing through each of the silicon anodes 11, the spacers 21, and the gaskets 31 thereby providing structural rigidity to the anodic unit 1. End plates 161 may be provided at either end of the anodic unit 11 to distribute the force equally upon the anodic unit 1.

The rods or bars 37 may be spaced every 6 or 9 or 12 or 15 or 18 or 24 inches to provide even compression of the gasket means 31. The compressive means 35 provide a compressive force on the assembly 1 thereby providing electrolyte tight seal between each of the silicon anodes 11 and the adjacent gaskets 31 and between each of the spacers 21 and the adjacent gaskets 31. In this way, an electrolyte tight anodic unit 1 is provided such that there is no seepage of electrolyte between adjacent cells in the bipolar electrolyzer 101.

In one exemplification of this invention, elastic spring clip means 51 provide electrical connection between the cathodic unit 133 of the bipolar unit 122 and the anodic unit 1 of the bipolar unit 122. According to another exemplification of this invention, conductive, threaded studs or rods 43 may extend outwardly from the base of the anode 11 and the cathode unit 132 may be suitably bonded thereto.

The cathodic unit 133 bipolar unit 122 includes a metal backscreen 135 with cathode fingers 131 extending outwardly therefrom. The metal backscreen 135 and the cathode fingers 131 are fabricated of an electrolyte permeable, alkali-resistant, electroconductive material. The material may be iron, steel, iron alloys of cobalt, nickel manganese, or the like. The metal itself may be in the form of a mesh, perforated plate, expanded metal mesh, or the like.

The metal backscreen 135 extends substantially from one edge of the bipolar unit 122 to the opposite edge of the bipolar unit 122 and from the top of the bipolar unit 122 to the bottom of the bipolar unit 122 and is substantially parallel to the anodic unit of the next adjacent cell, which is the anodic unit of the bipolar unit. The metal backscreen 135 is spaced from the anodic unit 1 of the bipolar unit 122 to provide a catholyte volume for hydrogen and cell liquor.

Cathode fingers 131 extend outwardly from the cathodic backscreen 135. The cathode fingers 131 are hollow, finger-like permeable metal structures, generally fabricated of the same material as the metal backscreen 135 as described hereinabove. The cathode fingers 131 are joined to the backscreen 135 at the bases of the cathode fingers, such as by welding or bolting and extend outwardly from the backscreen so as to be interleaved between the anodes 11 of the cell.

Electroconductive means 150 extend from the cathode fingers 131 to the backscreen 135 to the elastic clip 51 or threaded bolt 43 of the next adjacent cell, that is, to the elastic clip 51 or threaded bolt 43 of the anodic unit of the bipolar unit.

The cathode fingers 131 and cathodic backscreen 135 further include a permeable barrier separating the anolyte liquor from the catholyte liquor. The permeable barrier may be electrolyte permeable as a diaphragm or electrolyte impermeable but cation permeable as a permionic membrane. Where the permeable barrier is electrolyte permeable as a diaphragm, it may be an asbestos diaphragm, a treated asbestos diaphragm, as a diaphragm containing fluorocarbon additives, inoganic additives, or a thermally treated diaphragm or the like. Typically, when the permeable barrier is an asbestos diaphragm, it contains from about 0.2 to about 0.4 pounds of asbestos per square foot of cathode area.

When the permeable barrier is an electrolyte impermeable cation permeable barrier, as a permionic membrane, it is typically provided by a microporous fluorocarbon resin sheet, such as a DuPont "NAFION" fluorocarbon resin sheet formed from an interpolymer having perfluoroethylene units and fluorocarbon sulfonic acid units.

While the invention has been described with respect to certain particular exemplifications and embodiments thereof, it is not to be so limited as changes and alterations therein may be made which are within the full intended scope of this invention as defined by the appended claims.

I claim:

1. A bipolar electrolyzer comprising a plurality of electrolytic cells electrically and mechanically in series, at least one of said comprising an anode assembly of one bipolar unit and a cathode assembly of the next adjacent bipolar unit in the electrolyzer;

A. said anode assembly comprising:

1. a plurality of parallel silicon anodes, each of said anodes comprising a silicon substrate having an electrical conductivity greater than about 100 (ohm-centimeters)$^{-1}$, an electrically conductive surface thereon, an aperture passing through the base portion of said silicon substrate, and elastic clip means on the base of said silicon anodes adapted for connection with corresponding means on the cathode assembly of adjacent bipolar electrolyte cell;
2. a plurality of electrolyte-resistant spacers, at least one of said spacers being disposed between a pair of adjacent silicon anodes, each of said spacers having an aperture corresponding to the apertures in said silicon substrates;
3. a plurality of flexible gaskets, at least one of said flexible gaskets being interposed between a spacer and the silicon adjacent to one surface thereof, and at least one of said flexible gaskets being interposed between the opposite surface of the spacer and the silicon anode adjacent thereto; each of the said flexible gaskets having an aperture corresponding to the apertures in the silicon substrates and the spacers;
4. compressive means passing through each of said silicon anodes, said flexible gaskets, and said spacers, providing a compressive force thereon whereby to provide an electrolyte tight seal between each of said silicon anodes and the flexible gaskets adjacent thereto, and between each of said spacers and the flexible gaskets adjacent thereto, whereby to form an electrolyte tight wall having silicon anodes extending outwardly from one side thereof and electrical connection means extending on the opposite side thereof;

B. said cathode assembly comprising:

1. an electrolyte permeable, metal backscreen, extending substantially from one edge of the bipolar unit to the opposite edge thereof and substantially from the bottom of the bipolar unit to the top thereof, and substantially parallel to and spaced from the anodic unit of the next adjacent electrolyte cell;
2. a plurality of hollow, finger-like metal cathodes joined to said backscreen at the bases thereof, extending outwardly from said backscreen and interleaved between said anodes; said cathodes having electrolyte permeable walls;
3. electroconductive means extending from said cathodes through said backscreen to elastic clip means corresponding to elastic clip means of the anode assembly of the next adjacent electrolytic cell.

2. The bipolar electrolyzer of claim 1 wherein said spacers are silicon spacers.

3. The bipolar electrolyzer of claim 1 wherein said elastic clip is bolted to the base of said anode.

* * * * *